US009046826B2

(12) United States Patent
Ito

(10) Patent No.: US 9,046,826 B2
(45) Date of Patent: Jun. 2, 2015

(54) BELT UNIT, TRANSFER UNIT AND IMAGE FORMATION APPARATUS

(71) Applicant: Oki Data Corporation, Tokyo (JP)

(72) Inventor: Michiaki Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 141 days.

(21) Appl. No.: 13/710,535

(22) Filed: Dec. 11, 2012

(65) Prior Publication Data

US 2013/0164050 A1 Jun. 27, 2013

(30) Foreign Application Priority Data

Dec. 21, 2011 (JP) ..... 2011-279807

(51) Int. Cl.
*G03G 15/01* (2006.01)
*G03G 15/16* (2006.01)

(52) U.S. Cl.
CPC ..... *G03G 15/1605* (2013.01); *G03G 15/162* (2013.01)

(58) Field of Classification Search
CPC ..... G03G 15/5054; G03G 15/1615; G03G 2215/00139
See application file for complete search history.

(56) References Cited

U.S. PATENT DOCUMENTS 7,209,683 B2 * 4/2007 Abe et al. ..... 399/168
2010/0284718 A1 * 11/2010 Ito ..... 399/350

FOREIGN PATENT DOCUMENTS

JP H10-240025 A 9/1998
JP 2002-116629 A 4/2002
JP 2007-225959 A 9/2007
JP 2010-197579 A 9/2010
JP 2010-262158 A 11/2010

* cited by examiner

*Primary Examiner* — Clayton E Laballe
*Assistant Examiner* — Victor Verbitsky
(74) *Attorney, Agent, or Firm* — Marvin A. Motsenbocker; Mots Law, PLLC

(57) ABSTRACT

A belt unit includes rolls being rotatably supported and a belt to be conveyed by the rolls. In a dynamic viscoelasticity test with conditions of tensile load set in a frequency range of 0.01 to 100 [Hz], the belt unit satisfies $1 \leq G_{10}/G_{70} \leq 3.1$, and $L_{70} \geq 10$ [MPa]. A storage elastic modulus of the belt at a temperature of 10[° C.] is indicated by $G_{10}$. A storage elastic modulus of the belt at a temperature of 70[° C.] is indicated by $G_{70}$. A loss elastic modulus of the belt at a temperature of 70[° C.] is indicated by $L_{70}$.

20 Claims, 15 Drawing Sheets

TABLE 1A

CONDITIONS (1) TO (4) ($G_{10} \geq 100$[MPa], $G_{70} \geq 100$[MPa], $1 \leq G_{10}/G_{70} \leq 3.1$, $L_{70} \geq 10$[MPa])

| EXPERIMENTAL EXAMPLE | STORAGE ELASTIC MODULUS $G_{10}$ [MPa] AT 10°C | STORAGE ELASTIC MODULUS $G_{70}$ [MPa] AT 70°C | STORAGE ELASTIC MODULUS RATIO $G_{10}/G_{70}$ | LOSS ELASTIC MODULUS $L_{70}$ [MPa] AT 70°C | TIME TO BREAKAGE [H] | EVALUATION |
|---|---|---|---|---|---|---|
| 1 | $9.8 \times 10^{+0}$ | $7.6 \times 10^{+0}$ | 1.3 | $5.1 \times 10^{-1}$ | 240 | × |
| 2 | $1.1 \times 10^{+1}$ | $1.0 \times 10^{+1}$ | 1.1 | $6.0 \times 10^{-1}$ | 260 | × |
| 3 | $1.8 \times 10^{+2}$ | $1.1 \times 10^{+2}$ | 1.6 | $1.0 \times 10^{+2}$ | 350 | ○ |
| 4 | $5.4 \times 10^{+2}$ | $3.7 \times 10^{+2}$ | 1.5 | $2.1 \times 10^{+1}$ | 380 | ○ |
| 5 | $9.7 \times 10^{+2}$ | $2.9 \times 10^{+2}$ | 3.3 | $3.1 \times 10^{+1}$ | 280 | × |
| 6 | $1.1 \times 10^{+3}$ | $1.1 \times 10^{+3}$ | 1.0 | $9.9 \times 10^{+0}$ | 270 | × |
| 7 | $1.8 \times 10^{+3}$ | $1.5 \times 10^{+3}$ | 1.2 | $1.0 \times 10^{+2}$ | 400 | ◎ |
| 8 | $2.5 \times 10^{+3}$ | $1.7 \times 10^{+3}$ | 1.5 | $1.2 \times 10^{+2}$ | 420 | ◎ |
| 9 | $6.2 \times 10^{+3}$ | $5.5 \times 10^{+3}$ | 1.1 | $3.0 \times 10^{+2}$ | 470 | ◎ |
| 10 | $9.3 \times 10^{+3}$ | $3.5 \times 10^{+3}$ | 2.7 | $3.8 \times 10^{+2}$ | 410 | ◎ |
| 11 | $9.5 \times 10^{+3}$ | $5.5 \times 10^{+3}$ | 1.7 | $5.0 \times 10^{+2}$ | 450 | ◎ |
| 12 | $9.4 \times 10^{+3}$ | $5.1 \times 10^{+3}$ | 1.8 | $8.0 \times 10^{+2}$ | 460 | ◎ |
| 13 | $3.7 \times 10^{+3}$ | $1.2 \times 10^{+3}$ | 3.1 | $1.2 \times 10^{+2}$ | 410 | ◎ |
| 14 | $3.5 \times 10^{+3}$ | $1.1 \times 10^{+3}$ | 3.2 | $1.4 \times 10^{+2}$ | 290 | × |

FIG. 4

TABLE 1A

CONDITIONS (1) TO (4) ($G_{10}$ ≥100[MPa], $G_{70}$ ≥100[MPa], 1≤$G_{10}$ /$G_{70}$ ≤3.1, $L_{70}$ ≥10[MPa])

| EXPERIMENTAL EXAMPLE | STORAGE ELASTIC MODULUS $G_{10}$ [MPa] AT 10°C | STORAGE ELASTIC MODULUS $G_{70}$ [MPa] AT 70°C | STORAGE ELASTIC MODULUS RATIO $G_{10}/G_{70}$ | LOSS ELASTIC MODULUS $L_{70}$ [MPa] AT 70°C | TIME TO BREAKAGE [H] | EVALUATION |
|---|---|---|---|---|---|---|
| 1 | $9.8 \times 10^{+0}$ | $7.6 \times 10^{+0}$ | 1.3 | $5.1 \times 10^{-1}$ | 240 | × |
| 2 | $1.1 \times 10^{+1}$ | $1.0 \times 10^{+1}$ | 1.1 | $6.0 \times 10^{-1}$ | 260 | × |
| 3 | $1.8 \times 10^{+2}$ | $1.1 \times 10^{+2}$ | 1.6 | $1.0 \times 10^{+2}$ | 350 | ○ |
| 4 | $5.4 \times 10^{+2}$ | $3.7 \times 10^{+2}$ | 1.5 | $2.1 \times 10^{+1}$ | 380 | ○ |
| 5 | $9.7 \times 10^{+2}$ | $2.9 \times 10^{+2}$ | 3.3 | $3.1 \times 10^{+1}$ | 280 | × |
| 6 | $1.1 \times 10^{+3}$ | $1.1 \times 10^{+3}$ | 1.0 | $9.9 \times 10^{+0}$ | 270 | × |
| 7 | $1.8 \times 10^{+3}$ | $1.5 \times 10^{+3}$ | 1.2 | $1.0 \times 10^{+2}$ | 400 | ◎ |
| 8 | $2.5 \times 10^{+3}$ | $1.7 \times 10^{+3}$ | 1.5 | $1.2 \times 10^{+2}$ | 420 | ◎ |
| 9 | $6.2 \times 10^{+3}$ | $5.5 \times 10^{+3}$ | 1.1 | $3.0 \times 10^{+2}$ | 470 | ◎ |
| 10 | $9.3 \times 10^{+3}$ | $3.5 \times 10^{+3}$ | 2.7 | $3.8 \times 10^{+2}$ | 410 | ◎ |
| 11 | $9.5 \times 10^{+3}$ | $5.5 \times 10^{+3}$ | 1.7 | $5.0 \times 10^{+2}$ | 450 | ◎ |
| 12 | $9.4 \times 10^{+3}$ | $5.1 \times 10^{+3}$ | 1.8 | $8.0 \times 10^{+2}$ | 460 | ◎ |
| 13 | $3.7 \times 10^{+3}$ | $1.2 \times 10^{+3}$ | 3.1 | $1.2 \times 10^{+2}$ | 410 | ◎ |
| 14 | $3.5 \times 10^{+3}$ | $1.1 \times 10^{+3}$ | 3.2 | $1.4 \times 10^{+2}$ | 290 | × |

FIG.5 TABLE 1B

CONDITIONS (3) TO (6) ($G_{10}$ ≥1000[MPa], $G_{70}$ ≥1000[MPa], 1≤$G_{10}$ /$G_{70}$ ≤3.1, $L_{70}$ ≥10[MPa])

| EXPERIMENTAL EXAMPLE | STORAGE ELASTIC MODULUS $G_{10}$ [MPa] AT 10℃ | STORAGE ELASTIC MODULUS $G_{70}$ [MPa] AT 70℃ | STORAGE ELASTIC MODULUS RATIO $G_{10}/G_{70}$ | LOSS ELASTIC MODULUS $L_{70}$ [MPa] AT 70℃ | TIME TO BREAKAGE [H] | EVALUATION |
|---|---|---|---|---|---|---|
| 1 | $9.8 \times 10^{+0}$ | $7.6 \times 10^{+0}$ | 1.3 | $5.1 \times 10^{-1}$ | 240 | × |
| 2 | $1.1 \times 10^{+1}$ | $1.0 \times 10^{+1}$ | 1.1 | $6.0 \times 10^{-1}$ | 260 | × |
| 3 | $1.8 \times 10^{+2}$ | $1.1 \times 10^{+2}$ | 1.6 | $1.0 \times 10^{+2}$ | 350 | ○ |
| 4 | $5.4 \times 10^{+2}$ | $3.7 \times 10^{+2}$ | 1.5 | $2.1 \times 10^{+1}$ | 380 | ○ |
| 5 | $9.7 \times 10^{+2}$ | $2.9 \times 10^{+2}$ | 3.3 | $3.1 \times 10^{+1}$ | 280 | × |
| 6 | $1.1 \times 10^{+3}$ | $1.1 \times 10^{+3}$ | 1.0 | $9.9 \times 10^{+0}$ | 270 | × |
| 7 | $1.8 \times 10^{+3}$ | $1.5 \times 10^{+3}$ | 1.2 | $1.0 \times 10^{+2}$ | 400 | ◎ |
| 8 | $2.5 \times 10^{+3}$ | $1.7 \times 10^{+3}$ | 1.5 | $1.2 \times 10^{+2}$ | 420 | ◎ |
| 9 | $6.2 \times 10^{+3}$ | $5.5 \times 10^{+3}$ | 1.1 | $3.0 \times 10^{+2}$ | 470 | ◎ |
| 10 | $9.3 \times 10^{+3}$ | $3.5 \times 10^{+3}$ | 2.7 | $3.8 \times 10^{+2}$ | 410 | ◎ |
| 11 | $9.5 \times 10^{+3}$ | $5.5 \times 10^{+3}$ | 1.7 | $6.0 \times 10^{+2}$ | 450 | ◎ |
| 12 | $9.4 \times 10^{+3}$ | $5.1 \times 10^{+3}$ | 1.8 | $8.0 \times 10^{+2}$ | 460 | ◎ |
| 13 | $3.7 \times 10^{+3}$ | $1.2 \times 10^{+3}$ | 3.1 | $1.2 \times 10^{+2}$ | 410 | ◎ |
| 14 | $3.5 \times 10^{+3}$ | $1.1 \times 10^{+3}$ | 3.2 | $1.4 \times 10^{+2}$ | 280 | × |

FIG.6 TABLE 1C

CONDITIONS (1) TO (3), (7) ($G_{10} \geq 100$[MPa], $G_{70} \geq 100$[MPa], $1 \leq G_{10}/G_{70} \leq 3.1$, $L_{70} \geq 100$[MPa])

| EXPERIMENTAL EXAMPLE | STORAGE ELASTIC MODULUS $G_{10}$ [MPa] AT 10℃ | STORAGE ELASTIC MODULUS $G_{70}$ [MPa] AT 70℃ | STORAGE ELASTIC MODULUS RATIO $G_{10}/G_{70}$ | LOSS ELASTIC MODULUS $L_{70}$ [MPa] AT 70℃ | TIME TO BREAKAGE [H] | EVALUATION |
|---|---|---|---|---|---|---|
| 1 | $9.8 \times 10^{+0}$ | $7.8 \times 10^{+0}$ | 1.3 | $5.1 \times 10^{-1}$ | 240 | × |
| 2 | $1.1 \times 10^{+1}$ | $1.0 \times 10^{+1}$ | 1.1 | $6.0 \times 10^{-1}$ | 260 | × |
| 3 | $1.8 \times 10^{+2}$ | $1.1 \times 10^{+2}$ | 1.6 | $1.0 \times 10^{+2}$ | 350 | ○ |
| 4 | $5.4 \times 10^{+2}$ | $3.7 \times 10^{+2}$ | 1.5 | $2.1 \times 10^{+1}$ | 380 | ○ |
| 5 | $9.7 \times 10^{+2}$ | $2.9 \times 10^{+2}$ | 3.3 | $3.1 \times 10^{+1}$ | 280 | × |
| 6 | $1.1 \times 10^{+3}$ | $1.1 \times 10^{+3}$ | 1.0 | $9.9 \times 10^{+0}$ | 270 | × |
| 7 | $1.8 \times 10^{+3}$ | $1.5 \times 10^{+3}$ | 1.2 | $1.0 \times 10^{+2}$ | 400 | ◎ |
| 8 | $2.5 \times 10^{+3}$ | $1.7 \times 10^{+3}$ | 1.5 | $1.2 \times 10^{+2}$ | 420 | ◎ |
| 9 | $6.2 \times 10^{+3}$ | $5.5 \times 10^{+3}$ | 1.1 | $3.0 \times 10^{+2}$ | 470 | ◎ |
| 10 | $9.3 \times 10^{+3}$ | $3.5 \times 10^{+3}$ | 2.7 | $3.8 \times 10^{+2}$ | 410 | ◎ |
| 11 | $9.5 \times 10^{+3}$ | $5.5 \times 10^{+3}$ | 1.7 | $5.0 \times 10^{+2}$ | 450 | ◎ |
| 12 | $9.4 \times 10^{+3}$ | $5.1 \times 10^{+3}$ | 1.8 | $9.0 \times 10^{+2}$ | 460 | ◎ |
| 13 | $3.7 \times 10^{+3}$ | $1.2 \times 10^{+3}$ | 3.1 | $1.2 \times 10^{+2}$ | 410 | ◎ |
| 14 | $3.5 \times 10^{+3}$ | $1.1 \times 10^{+3}$ | 3.2 | $1.4 \times 10^{+2}$ | 290 | × |

FIG. 10 TABLE 2A

●: NO POOR CLEANING,
○: ONLY MINOR POOR CLEANING,
×: POOR CLEANING
CONDITIONS (8) AND (9) (5.5[GPA]≤Y≤10[GPA], 50≤M≤100)

| EXPERIMENTAL EXAMPLE | INDENTATION YOUNG'S MODULUS Y | SPECULARITY M | CLEANING PERFORMANCE EVALUATION (0.5%) | CLEANING PERFORMANCE EVALUATION (7%) | CLEANING PERFORMANCE EVALUATION (25%) |
|---|---|---|---|---|---|
| 21 | 5.0 | 30 | × | × | × |
| 22 | 5.0 | 70 | × | × | × |
| 23 | 5.0 | 100 | × | × | × |
| 24 | 5.5 | 50 | ○ | ○ | ○ |
| 25 | 5.5 | 70 | ○ | ○ | ○ |
| 26 | 5.5 | 100 | ○ | ○ | ○ |
| 27 | 6.0 | 65 | ○ | ○ | ○ |
| 28 | 7.0 | 50 | ○ | ○ | ○ |
| 29 | 7.0 | 70 | ● | ● | ● |
| 30 | 7.0 | 80 | ● | ● | ● |
| 31 | 7.0 | 100 | ● | ● | ● |
| 32 | 8.0 | 25 | × | × | × |
| 33 | 8.0 | 40 | × | × | × |
| 34 | 9.0 | 50 | ○ | ○ | ○ |
| 35 | 9.0 | 70 | ● | ● | ● |
| 36 | 9.0 | 100 | ● | ● | ● |
| 37 | 10.0 | 40 | × | × | × |
| 38 | 10.0 | 50 | ○ | ○ | ○ |
| 39 | 10.0 | 70 | ● | ● | ● |
| 40 | 10.0 | 100 | ● | ● | ● |

FIG. 11 TABLE 2B

●: NO POOR CLEANING,
○: ONLY MINOR POOR CLEANING,
×: POOR CLEANING
CONDITIONS (10) AND (11) (7[GPA]≤Y≤10[GPA], 70≤M≤100)

| EXPERIMENTAL EXAMPLE | INDENTATION YOUNG'S MODULUS Y | SPECULARITY M | CLEANING PERFORMANCE EVALUATION (0.5%) | CLEANING PERFORMANCE EVALUATION (7%) | CLEANING PERFORMANCE EVALUATION (25%) |
|---|---|---|---|---|---|
| 21 | 5.0 | 30 | × | × | × |
| 22 | 5.0 | 70 | × | × | × |
| 23 | 5.0 | 100 | × | × | × |
| 24 | 5.5 | 50 | ○ | ○ | ○ |
| 25 | 5.5 | 70 | ○ | ○ | ○ |
| 26 | 5.5 | 100 | ○ | ○ | ○ |
| 27 | 6.0 | 65 | ○ | ○ | ○ |
| 28 | 7.0 | 50 | ○ | ○ | ○ |
| 29 | 7.0 | 70 | ● | ● | ● |
| 30 | 7.0 | 80 | ● | ● | ● |
| 31 | 7.0 | 100 | ● | ● | ● |
| 32 | 8.0 | 25 | × | × | × |
| 33 | 8.0 | 40 | × | × | × |
| 34 | 9.0 | 50 | ○ | ○ | ○ |
| 35 | 9.0 | 70 | ● | ● | ● |
| 36 | 9.0 | 100 | ● | ● | ● |
| 37 | 10.0 | 40 | × | × | × |
| 38 | 10.0 | 50 | ○ | ○ | ○ |
| 39 | 10.0 | 70 | ● | ● | ● |
| 40 | 10.0 | 100 | ● | ● | ● |

BELT UNIT, TRANSFER UNIT AND IMAGE FORMATION APPARATUS

CROSS REFERENCE TO RELATED APPLICATIONS

This application claims priority based on 35 USC 119 from prior Japanese Patent Application No. 2011-279807 filed on Dec. 21, 2011, entitled "BELT UNIT, TRANSFER UNIT AND IMAGE FORMATION APPARATUS", the entire contents of which are incorporated herein by reference.

BACKGROUND OF THE INVENTION

1. Field of the Invention

This disclosure relates to a belt unit having a belt, a transfer unit having the belt unit, and an image formation apparatus having the belt unit.

2. Description of Related Art

A general electrophotographic image formation apparatus uses an endless belt as a conveyance belt configured to convey recording paper to which a developer image (toner image) is to be transferred, or an endless belt as an intermediate transfer belt configured to temporarily hold and carry the toner image to be transferred to the recording paper (e.g., see FIGS. 1 and 5 in Japanese Patent Application Publication No. 2005-79262). The toner attached to the endless belt is scraped off by a cleaning blade being in contact with an outer peripheral surface of the endless belt (e.g., see FIG. 2 in Japanese Patent Application Publication No. 2005-79262).

SUMMARY OF THE INVENTION

However, long-term use of the belt degrades its reliability. Thus, the problem is how to achieve a longer lasting belt.

An object of an embodiment of the invention is to improve the reliability of a belt in long-term use.

An aspect of the invention is a belt unit that includes rolls being rotatably supported and a belt to be conveyed by the rolls. In a dynamic viscoelasticity test with conditions of tensile load set in a frequency range of 0.01 to 100 [Hz], the belt unit satisfies the conditions $1 \leq G_{10}/G_{70} \leq 3.1$, and $L_{70} \geq 10$ [MPa]. A storage elastic modulus of the belt at a temperature of 10[° C.] is indicated by $G_{10}$. A storage elastic modulus of the belt at a temperature of 70[° C.] is indicated by $G_{70}$. A loss elastic modulus of the belt at a temperature of 70[° C.] is indicated by $L_{70}$.

According to the aspect of the invention, the reliability of the belt in long-term use is improved.

BRIEF DESCRIPTION OF THE DRAWINGS

FIG. 4 is Table 1A of results of experiments conducted to derive conditions satisfied by the first embodiment, showing the grounds for derivation of conditions (1), (2), (3) and (4) by hatching.

FIG. 5 is Table 1B of results of experiments conducted to derive conditions satisfied by the first embodiment, showing the grounds for derivation of conditions (5), (6), (3) and (4) by hatching.

FIG. 6 is Table 1C of results of experiments conducted to derive conditions satisfied by the first embodiment, showing the grounds for derivation of conditions (1), (2), (3) and (7) by hatching.

FIG. 10 is Table 2A of results of experiments conducted to derive conditions satisfied by a second embodiment, showing the grounds for derivation of conditions (8) and (9) by hatching.

FIG. 11 is Table 2B of results of experiments conducted to derive conditions satisfied by the second embodiment, showing the grounds for derivation of conditions (10) and (11) by hatching.

DETAILED DESCRIPTION OF EMBODIMENTS

Figure 1:
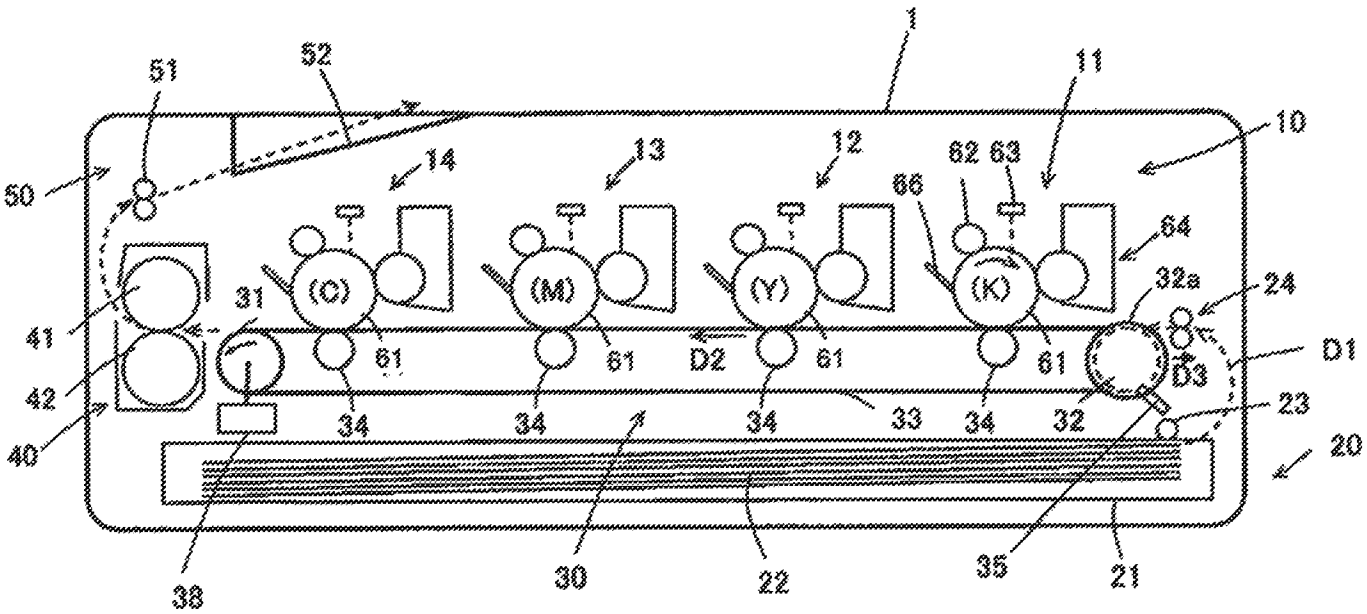
FIG. 1 is a longitudinal sectional view schematically showing a structure of an image formation apparatus of a first embodiment according to the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

<<1>> First Embodiment

<<1-1>> Overview of Image Formation Apparatus, Transfer Unit and Belt Unit

Figure 2:
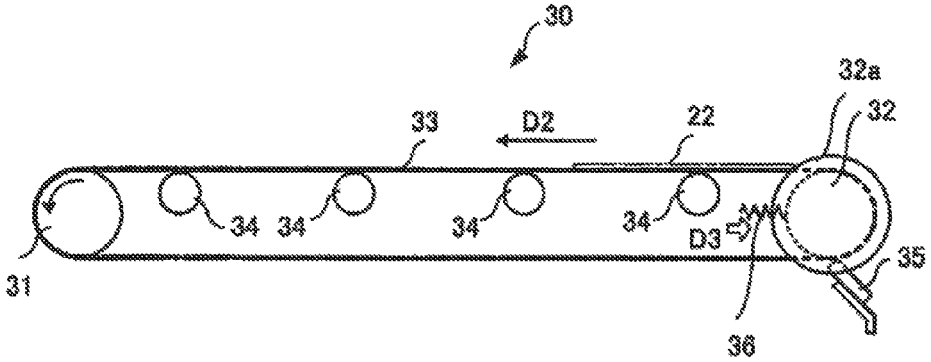
FIG. 2 is a longitudinal sectional view schematically showing a structure of a transfer unit included in the image formation apparatus shown in FIG. 1.
Figure 3:
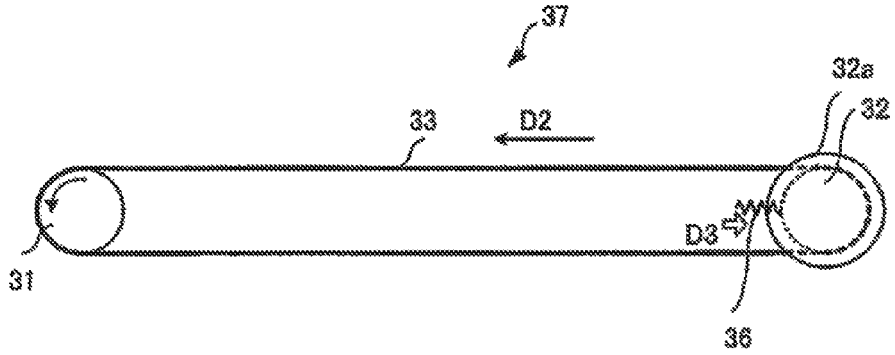
FIG. 3 is a longitudinal sectional view schematically showing a structure of a belt unit included in the image formation apparatus shown in FIG. 1.

FIG. 1 is a longitudinal sectional view schematically showing a structure of image formation apparatus 1 of a first embodiment according to the invention. FIG. 2 is a longitudinal sectional view schematically showing a structure of transfer unit 30 included in image formation apparatus 1. FIG. 3 is a longitudinal sectional view schematically showing a structure of belt unit 37 included in image formation apparatus 1. While, in the first embodiment, belt unit 37 is a part of transfer unit 30, the invention is also applicable to belt units for other purposes than the transfer unit.

As shown in FIG. 1, image formation apparatus 1 includes, as main components, image formation unit 10, paper feeder 20, transfer unit 30, fixer 40, and discharger 50. Image formation apparatus 1 is a tandem color printer including electrophotographic image formation units 11, 12, 13 and 14.

As shown in FIG. 1, image formation unit 10 has image formation units 11, 12, 13 and 14 arranged along a conveyance path (in a horizontal direction in FIG. 1) of recording paper 22 as a recording medium and detachably mounted on the main body of image formation apparatus 1. Image formation units 11, 12, 13 and 14 use electrophotography to form developer images (toner images) of respective colors of black (K), yellow (Y), magenta (M), and cyan (C). Image formation units 11, 12, 13 and 14 have the same structure except that they use different toner colors. Image formation unit 11 includes photosensitive drum 61 as an image carrier, charger 62 configured to uniformly charge the surface of photosensitive drum 61, exposure unit (e.g., a LED head) 63 including a light emitting element (e.g., a LED array) to form an electrostatic latent image based on image data by irradiating light to the charged surface of photosensitive drum 61, development unit 64 configured to form a toner image by developing the electrostatic latent image formed on the surface of photosensitive drum 61, and cleaning blade 65 configured to remove the toner remaining on the surface of photosensitive drum 61. The other image formation units 12, 13 and 14 have the same structure as that of image formation unit 11. Note that the number of the image formation units, the arrangement thereof, and the kinds of the toners are not limited to those in the example shown in FIG. 1.

As shown in FIG. 1, paper feeder 20 includes paper cassette 21 configured to store recording paper 22, paper feed roller 23 configured to take recording paper 22 out of paper cassette 21, and conveyance roller 24 configured to carry recording paper 22 to image formation unit 10. Recording paper 22 stored in paper cassette 21 is taken out one by one by paper feed roller 23, carried in the D1 direction on a paper conveyance path, and sent to image formation unit 10.

As shown in FIGS. 1 and 2, transfer unit 30 includes drive roll 31 and driven roll 32 rotatably supported inside image formation apparatus 1, endless belt 33 provided around drive roll 31 and driven roll (tension roll) 32 and configured to convey recording paper 22 by electrostatic adsorption, transfer roller 34 as a transfer unit configured to transfer the toner image carried on photosensitive drum 61 to recording paper 22 conveyed by endless belt 33, cleaning blade 35 as a cleaning unit configured to scrape off the residual toner by coming into contact with the outer peripheral surface of endless belt 33, and biasing member 36 such as an elastic member (e.g., a spring) configured to exert a force outwardly on driven roll 32 (in the D3 direction). As shown in FIG. 3, drive roll 31, driven roll 32 and endless belt 33 are included in belt unit 37. Drive roll 31 is rotated by a drive force from belt drive unit 38 to move endless belt 33 in the D2 direction. Belt drive unit 38 includes a drive force generator such as a motor and a drive force transmitter such as a gear. Endless belt 33 is tightened by drive roll 31 and driven roll 32 in a state where tensile force (e.g., 6±10% [kg], i.e., 5.4 [kg] to 6.6 [kg]) is applied thereto by biasing member 36. Transfer roller 34 is disposed facing photosensitive drum 61 so as to sandwich endless belt 33 therebetween in order to transfer the toner image formed on photosensitive drum 61 to recording paper 22. Transfer roller 34 is disposed facing respective image formation units 11, 12, 13 and 14. Driven roll 32 may include flange 32*a* to prevent meandering of endless belt 33 by coming into contact with the side of endless belt 33. As necessary, the flange may be provided in the other roll (e.g., drive roll 31) or may be provided on both ends of one roll (e.g., driven roll 32 or drive roll 31).

As shown in FIG. 1, fixer 40 includes heat generation roller 41 and pressure roller 42, for example. Fixer 90 fixes the toner image onto recording paper 22 by applying heat and pressure to the toner image formed on recording paper 22. Moreover, discharger 50 has discharge roller 51 configured to discharge recording paper 22 that has passed fixer 40 to discharge unit 52.

Next, operations of image formation apparatus 1 are described. The surfaces of photosensitive drums 61 in image formation units 11, 12, 13 and 14 are uniformly charged by charger 62. Then, photosensitive drums 61 are exposed by exposure unit 63 while being rotated in the arrow direction (clockwise direction in FIG. 1) to form electrostatic latent images on the surfaces of photosensitive drums 61. These electrostatic latent images are developed by development unit 64, and thus toner images are formed on the surfaces of photosensitive drums 61 in image formation units 11, 12, 13 and 14, respectively.

Recording paper 22 stored in paper cassette 21 is taken out of paper cassette 21 by paper feed roller 23 and conveyed by conveyance roller 24 and endless belt 33. When the rotation of photosensitive drum 61 brings the toner image on the surface of each photosensitive drum 61 close to transfer roller 34 and endless belt 33, the toner image on the surface of photosensitive drum 61 is transferred onto recording paper 22 by endless belt 33 and transfer roller 34 to which a voltage is applied. This transfer of the toner image onto recording paper 22 is performed every time the paper passes image formation units 11, 12, 13 and 14 configured to form toner images of respective colors of black (K), yellow (Y), magenta (M), and cyan (C). Accordingly, the toner images of the respective colors are superimposed on each other on recording paper 22, and thus a color image is formed.

Thereafter, recording paper 22 is conveyed to fixer 40 by the rotation of endless belt 33. The toner image on recording paper 22 is fused by the pressure and heat from fixer 40, and is fixed onto recording paper 22. Subsequently, recording paper 22 is discharged onto discharge tray 52 by discharge roller 51. Then, the image formation operation is completed. Meanwhile, the toner and foreign matter remaining on endless belt 33 after separation of recording paper 22 are removed by cleaning blade 35.

<<1-2>> Concrete Examples of Image Formation Apparatus, Transfer Unit and Belt Unit Endless belt 33 can be manufactured as follows, for example. First, a variety of polyamideimides (PAIs) are carefully selected, and then the PAIs are blended with an appropriate amount of carbon black to induce conductive properties of the PAIs. Thereafter, the PAIs blended with carbon black are mixed and stirred in an N-methylpyrrolidone (NMP) solution. Next, a solution containing the PAIs and carbon black is poured into a cylindrical mold (i.e., casted), and the mold is heated for a predetermined period of time at 80 to 120[° C.] while being rotated. The mold is subsequently heated to 200 to 350[° C.] for a predetermined period of time. Then, the solution is cured by cooling and removed from the mold (i.e., demolded). Through the above process, a raw tube of the endless belt having a thickness of 100±10 [μm] and a peripheral length of 624±1.5 [mm], for example, can be obtained. Thereafter, the raw tube of the endless belt is cut into pieces each having a width of 228±0.5 [mm], for example, thus obtaining endless belt 33. Note that, during casting while rotating the mold, the rotation speed of the cylindrical mold is preferably 5 to 1000 [rpm], and more preferably 10 to 500 [rpm] from the viewpoint of thickness accuracy and thickness profile of endless belt 33.

PAI as a constituent material of endless belt 33 has a series of a molecular structure in which an amide group is linked to one or two imide groups via an organic group. PAI is either an aliphatic PAI or an aromatic PAI depending on whether the organic group is aliphatic or aromatic. Endless belt 33 in the first embodiment is preferably formed of an aromatic PAI from a point of view of durability and mechanical characteristics. In the aromatic PAI, an organic group linking an imide group to an amide group basically takes the form of one or two benzene rings.

PAI as a constituent material of endless belt 33 may be a complete imide ring-closure or amide acid that is in a stage before an imide ring-closure. If the PAI contains an amide acid, then at least more than 50%, and preferably more than 70%, of the PAI should be imidized. This is because incorporation of a large percentage of amide acid in the PAI as a constituent material of endless belt 33 increases a rate of dimensional change. Note that a rate of imidization can be calculated using a Fourier transform infrared spectrophotometer (FT-IR) based on a ratio of intensity of imide group-derived absorption (1780 [$cm^{-1}$]) to benzene ring-derived absorption (1510 [$cm^{-1}$]).

As a method for increasing a Young's modulus of endless belt 33, there is a method using a molecular structure containing more aromatic rings or imide groups. On the contrary, as a method for reducing a Young's modulus of endless belt 33, there is a method using a molecular structure containing less aromatic rings or imide groups.

The material of endless belt 33 is not limited to PAI, but is preferably one that suppresses tensile deformation during the drive of the belt within a certain range from a point of view of durability and mechanical characteristics. Moreover, the material of endless belt 33 is preferably one that is less likely to suffer from damage such as lateral abrasion, lateral fracture and lateral breakage caused by a repeated sliding movement with flange 32*a* as the meandering prevention member. For example, as the material of endless belt 33, it is preferable to use, as in the case of PAI, a resin such as polyimide (PI), polycarbonate (PC), polyamide (PA), polyetheretherketone (PEEK), polyvinylidene difluoride (PVDF) and ethylene-tetrafluoroethylene copolymer (ETFE) having a Young's modulus of 2.0 [GPa] or more, and a mixture mainly containing each of the above. It is further preferable that the material has a Young's modulus of 3.0 [GPa] or more.

When endless belt 33 is manufactured by rotational molding, the solvent to be used is selected as appropriate depending on the material to be used. An organic polar solvent is suitable. As a useful organic polar solvent, N,N-dimethylacetamide is useful. N,N-dimethylacetamides include, for example, N,N-dimethylformamide, N,N-dimethylacetamide, N,N-diethylformamide, N,N-diethylacetamide, dimethyl sulfoxide, NMP, pyridine, tetramethylene sulfone, dimethyl tetramethylene sulfone, and the like. These solvents may be used alone or in combination.

As a method for molding endless belt 33, the following methods can be employed: a method of using a cylindrical mold obtained by combining a large-diameter mold and a small-diameter mold to form a belt between the two molds, or a method of applying a belt material onto an outer peripheral surface of a cylindrical mold or immersing a mold in a belt material to form a belt. No solvent is required for an endless belt manufactured by an extrusion molding method or an inflation molding method.

Carbon black to be added includes furnace black, channel black, ketjen black, and acetylene black. These materials may be used alone or in combination. Any of these materials may be employed depending on the electrical conductivity required for the endless belt. Furnace black or channel black is preferably used for endless belt 33 (or endless belt 133 for intermediate transfer to be described later) used to convey the paper in image formation apparatus 1. Depending on the intended use, furnace black may have undergone an antioxidant treatment, such as an oxidation treatment and craft treatment, or may have an improved dispersion into the solvent. The amount of carbon black may be selected depending on the intended use of the endless belt and the types of carbon black to be added. Endless belt 33 (or endless belt 133 for intermediate transfer to be described later) used to convey the paper in image formation apparatus 1 contains carbon black in an amount of 3 to 40 [wt %], more preferably 5 to 30 [wt %], and still more preferably 5 to 25 [wt %] with respect to the belt composition resin solid material in terms of required mechanical strength and the like.

The toner used in respective image formation units 11 to 14 contains paraffin wax in an amount of 9 weight parts based on 100 weight parts of styrene acrylic copolymer. The paraffin wax is internally added to the toner by an emulsion polymerization method. The toner particles preferably have an average diameter of 7 μm and a sphericity of 0.95. The reason for using such a toner is that the toner does not require a release agent for the fixer, and is excellent in transfer efficiency, dots reproducibility, and resolution, providing sharp images and high quality images.

Cleaning blade 35 is preferably formed of urethane rubber having a rubber hardness of 72° (JIS A) and a thickness of 1.5 mm. Cleaning blade 35 preferably applies a line pressure of 4.3 g/mm on endless belt 33. This is because a blade formed of an elastic material such as urethane rubber, as cleaning blade 35, is excellent in removing residual toner and foreign matter on the outer peripheral surface of endless belt 33, and is of simple structure, which implements a compact, low cost blade. Moreover, urethane rubber is employed for its high hardness, elasticity, wear-resistance, mechanical strength, oil-resistance, ozone-resistance, and the like. Generally, the hardness of urethane rubber used for cleaning blade 35 is preferably 60 to 90° (JIS A), and more preferably is 70 to 85° (JIS A) to maintain cleaning performance. Also, urethane rubber of cleaning blade 35 has a breaking elongation of preferably 250 to 500%, and more preferably 300 to 400%. Moreover, urethane rubber of cleaning blade 35 has a permanent elongation of preferably 1.0 to 5.0%, and more preferably 1.0 to 2.0%. Furthermore, urethane rubber of cleaning blade 35 has a rebound resilience of preferably 10 to 70%, and more preferably 30 to 50%. These physical properties can be measured in accordance with JIS K6301.

The contact thickness of cleaning blade 35 with endless belt 33 is preferably 1 to 6 g/mm, and more preferably is 2 to 5 g/mm in line pressure. This is because, if the line pressure is too small, the adhesion of cleaning blade 35 to endless belt 33 is insufficient, making poor cleaning likely to occur. On the other hand, if the line pressure is too large, cleaning blade 35 and endless belt 33 are in surface contact with each other, causing too much frictional resistance. In this case, pressing force is larger than scraping force, which is likely to cause poor cleaning called a "filming phenomenon" or trouble such as "turning-up." Here, the "filming phenomenon" means a phenomenon where residues on the endless belt are fused through many printing processes to form a filming film. Also, the "turning-up" means a phenomenon where increased frictional force due to an increase in adhesion and affinity between the cleaning blade and the residues on the endless belt results in pushing up and moving the tip of the cleaning blade.

Drive roll 31 and driven roll 32 have a shaft diameter of, for example, ϕ25 (diameter of 25 mm). However, the diameter is not limited to 25 mm. For example, a shaft diameter of ϕ10 to 50 (diameter of 10 to 50 mm) may be employed for implementing a low cost and small size image forming apparatus.

In the first embodiment, the description is given of the case where spring 36 is used to loop endless belt 33 at a tension of 6±10% [kg] (i.e., 5.4 [kg] to 6.6 [kg]). However, the method for looping endless belt 33 is not limited to the use of spring 36. The tension of looping endless belt 33 is also selected as appropriate depending on the belt material to be used or the belt drive unit. Generally, it is preferable that the belt is looped with the tension in the range of 2±10% [kg] (i.e., 1.8 [kg] to 2.2 [kg]) to 8±10% [kg] (i.e., 7.2 [kg] to 8.8 [kg]).

<<1-3>> Conditions Preferably Satisfied by the First Embodiment

FIG. 4 is Table 1A of results of experiments conducted to derive conditions satisfied by the first embodiment, showing the grounds for derivation of conditions (1) to (4) by hatching. Endless belt 33 of the first embodiment is configured to satisfy the following conditions (3) and (4) when conditions of tensile load in a dynamic viscoelasticity test are set in a frequency range of 0.01 to 100 [Hz], a storage elastic modulus of endless belt 33 at a temperature of 10[° C.] is indicated by $G_{10}$, a storage elastic modulus of endless belt 33 at a temperature of 70[° C.] is indicated by $G_{70}$, and a loss elastic modulus of endless belt 33 at a temperature of 70[° C.] is indicated by $L_{70}$.

$$1 \leq G_{10}/G_{70} \leq 3.1 \quad (3)$$

$$L_{70} \geq 10 \text{ [MPa]} \quad (4)$$

Endless belt 33 of the first embodiment is preferably configured to satisfy the following conditions (1) and (2).

$$G_{10} \geq 100 \text{ [MPa]} \quad (1)$$

$$G_{70} \geq 100 \text{ [MPa]} \quad (2)$$

Conditions (1) to (4) are obtained based on the test of the material of endless belt 33 under repeated stresses. FIG. 4 shows measured values of storage elastic moduli $G_{10}$ and $G_{70}$ and loss elastic moduli $L_{70}$ for different kinds of endless belt 33 for test (Experimental Examples 1 to 14). FIG. 4 also shows conditions for the storage elastic moduli $G_{10}$ and $G_{70}$ and loss elastic modulus $L_{70}$ that are preferably satisfied to allow endless belt 33 to have a predetermined durability (e.g., a durability for a predetermined period of time or more). In Table 1A shown in FIG. 4, the hatching region shows the measured values that satisfy conditions (1) to (4).

The reason for preferably satisfying conditions (1) and (2) is that if the storage elastic modulus $G_{10}$ or $G_{70}$ of endless belt 33 is less than 10 [MPa], stress is likely to be generated inside endless belt 33 by the repeated load to cause a problem in elongated endless belt 33.

The reason for the need to satisfy condition (3) is that when there is too large a difference in elastic modulus between temperatures in the region of 10 to 70[° C.], the elastic modulus varies significantly with temperature change. Moreover, if the elastic modulus is small, long-term use at higher temperatures is likely to cause further material fatigues. Generally, the higher the temperature, the lower the storage elastic modulus. Thus, a ratio of the storage elastic modulus at 10[° C.] to the storage elastic modulus at 70[° C.] (i.e., $G_{10}/G_{70}$) is 1 or more.

The reason for the need to satisfy condition (4) is that if the loss elastic modulus $L_{70}$ of endless belt 33 is less than 10 [MPa], stress is likely to be generated inside endless belt 33 by the repeated load to cause a problem in elongated endless belt 33.

As can be seen from the hatching regions in FIG. 4 showing the measured values for Experimental Examples 1 to 14, satisfying all conditions (1) to (4) makes it possible that the time to breakage of endless belt 33 is 350 [H (hours)] or longer (Evaluation: circle "○" and double circle "◎"). In Table 1A shown in FIG. 4, Experimental Examples 3, 4 and 7 to 13 satisfy conditions (1) to (4). Therefore, Experimental Examples 3, 4 and 7 to 13 are examples corresponding to one embodiment of the invention, while the other Experimental Examples 1, 2, 5, 6 and 14 are comparative examples of the invention.

FIG. 5 is Table 1B of results of experiments conducted to derive conditions satisfied by the first embodiment, showing the grounds for derivation of conditions (5), (6), (3) and (4) by hatching. For endless belt 33, storage elastic moduli $G_{10}$ and $G_{70}$ preferably satisfy the following conditions (5) and (6) when conditions of tensile load in a dynamic viscoelasticity test are set in a frequency range of 0.01 to 100 [Hz].

$$G_{10} \geq 1000 \text{ [MPa]} \quad (5)$$

$$G_{70} \geq 1000 \text{ [MPa]} \quad (6)$$

The reason for preferably satisfying the above conditions is that stress is less likely to be generated inside endless belt 33 by the repeated load, thereby reducing the occurrence of a problem with elongated endless belt 33.

As can be seen from the hatching regions in FIG. 5 showing the measured values for Experimental Examples 1 to 14, satisfying all conditions (5), (6), (3) and (4) makes it possible that the time to breakage of endless belt is 400 [H] or longer (Evaluation: double circle "◎"). In FIG. 5, Experimental Examples satisfying all conditions (5), (6), (3) and (4) are Experimental Examples 7 to 13.

FIG. 6 is Table 1C of results of experiments conducted to derive conditions satisfied by the first embodiment, showing the grounds for derivation of conditions (1), (2), (3) and (7) by hatching. For endless belt 33, the loss elastic modulus $L_{70}$ preferably satisfies the following condition (7) when conditions of tensile load in a dynamic viscoelasticity test are set in a frequency range of 0.01 to 100 [Hz].

$$L_{70} \geq 100 \text{ [MPa]} \quad (7)$$

The reason for preferably satisfying the above condition is that stress is less likely to be generated inside endless belt 33 by the repeated load, thereby reducing the occurrence of a problem in elongated endless belt 33.

As can be seen from the hatching regions in FIG. 6 showing the measured values for Experimental Examples 1 to 14, satisfying all conditions (1), (2), (3) and (7) makes it possible that the time to breakage of endless belt breaks is 350 [H] (Evaluation: some of double circles "◎" and circles "○"). In FIG. 6, Experimental Examples satisfying all conditions (1), (2), (3) and (7) are Experimental Examples 3 and 7 to 13.

However, from a technical point of view and a viewpoint of manufacturing and time, as well as a reduction in manufacturing yield and increased cost, it is very difficult to manufacture endless belt 33 so that the storage elastic modulus exceeds 10,000 [MPa] (=10 [GPa]). Also, for a similar reason, it is also very difficult to manufacture endless belt 33 so that the loss elastic modulus exceeds 800 [MPa]. Therefore, normally, the storage elastic modulus is 10,000 [MPa] or less, and the loss elastic modulus is 800 [MPa] or less.

<<1-4>> Method for Experiment Conducted to Derive Conditions (1) to (7)

An experiment to derive conditions (1) to (7) is performed as follows on belt unit 37 shown in FIG. 3. Dynamic viscoelastic measurement is performed using a dynamic viscoelastic measurement apparatus "DMS6100" manufactured by Seiko Instruments, Inc. (SII) in accordance with JIS K7249 (ISO6721) for a dynamic mechanical property test method. The dynamic viscoelastic measurement is a method for measuring mechanical properties of a sample by applying a distortion that changes (fluctuates) with time to the sample and measuring stress or distortion is thus generated. A DMS (dynamic mechanical spectroscopy) measurement in the first embodiment is performed in a tensile mode, and the frequency is changed sequentially to 0.01 [Hz], 0.1 [Hz], 1.0 [Hz], 10 [Hz] and 100 [Hz]. The measurement is performed with a minimum tensile force of 200 [mN], a tensile force of 1.5, a force amplitude initial value of 2000 [mN], and a temperature of 0 to 100[° C.]. Moreover, a distance between chucks configured to hold the target belt is set to 20 [mm], a width of the target endless belt is set to 5 [mm], and a thickness of the target belt is set to 0.1 [mm].

The reason for measuring the elastic modulus of dynamic viscoelasticity as the property of endless belt 33 in the first embodiment is that the measurement conditions for the dynamic viscoelasticity are close to the actual conditions of use of endless belt 33. Moreover, the elastic modulus obtained through the measurement of the dynamic viscoelasticity is a parameter close to an actual parameter of the use of endless belt 33 in image formation apparatus 1. In other words, it is considered to be more realistic to examine the elastic modulus of dynamic viscoelasticity rather than static mechanical properties since endless belt 33 operates while constantly undergoing elongation, compression and flexion while in use.

Evaluation criteria are described below. A durability evaluation is performed using the experimental apparatus as shown in FIG. 3. Endless belt 33 is looped around two rollers with ϕ20 at a load of 6 [kg]. A linear speed of endless belt 33 is about 300 [mm/sec]. An operation simulating printing conditions is performed, involving 2 [sec] moving and 1 [sec] pausing. The ambient temperature is set to 50[° C.].

As shown in FIGS. 4 to 6, a determination is made on whether or not endless belt 33 is broken. The circle mark "○" indicates that endless belt 33 is not broken, and the cross mark "x" indicates that endless belt 33 is broken.

A description is given below of the reason why the above experimental method is suitable for the evaluation of the characteristics of the endless belt. Endless belt 33 is rotated in a looped state under a predetermined stress. A usage environment of image formation apparatus 1 varies from a high-temperature and high-humidity environment, such as a temperature of 30[° C.] and a humidity of 80[%], to a low-temperature and low-humidity environment, such as a temperature of 10[° C.] and a humidity of 15[%].

<<1-5>> Effects of the First Embodiment

Belt unit 37 of the first embodiment prevents deterioration of endless belt 33 due to contact with a member such as cleaning blade 35.

Moreover, transfer unit 30 of the first embodiment prevents deterioration of endless belt 33 due to contact with cleaning blade 35.

Furthermore, image formation apparatus 1 of the first embodiment can prevent a deterioration of endless belt 33, enhance the durability of the apparatus, and also improve the quality of images formed on recording paper 22.

<<1-6>> Modified Example of the First Embodiment

Figure 7:
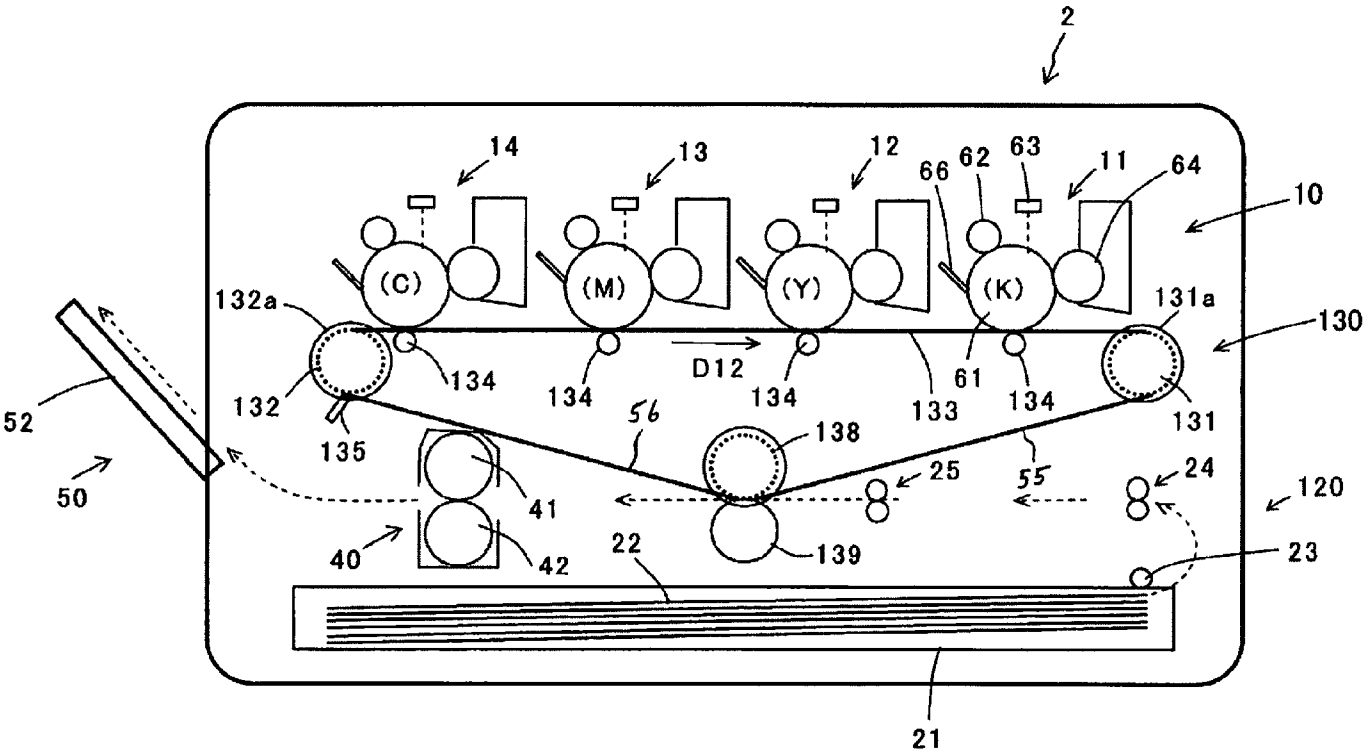
FIG. 7 is a longitudinal sectional view schematically showing a structure of an image formation apparatus according to a modified example of the first embodiment.
Figure 8:
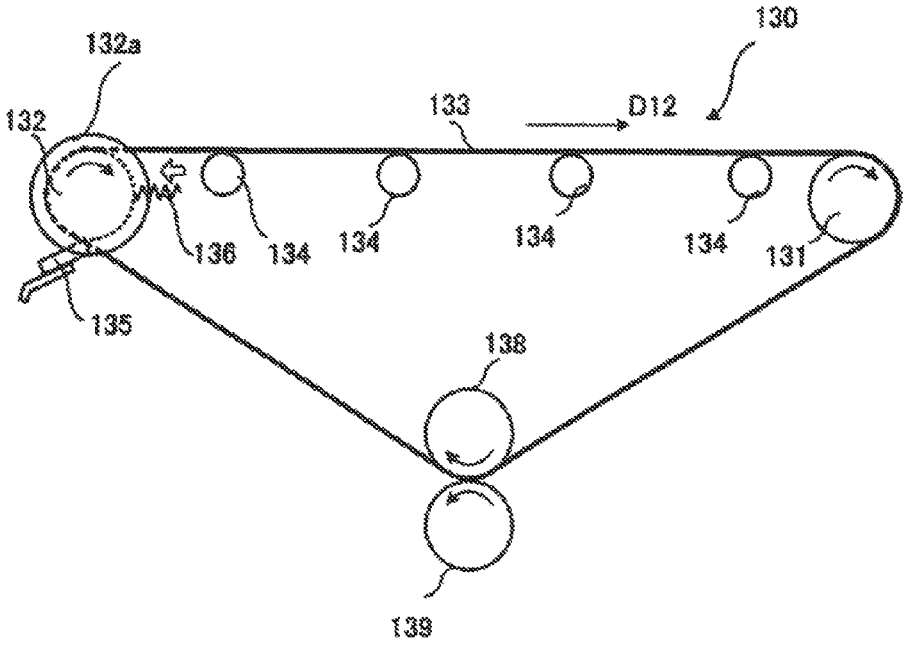
FIG. 8 is a longitudinal sectional view schematically showing a structure of a transfer unit included in the image formation apparatus shown in FIG. 7.
Figure 9:
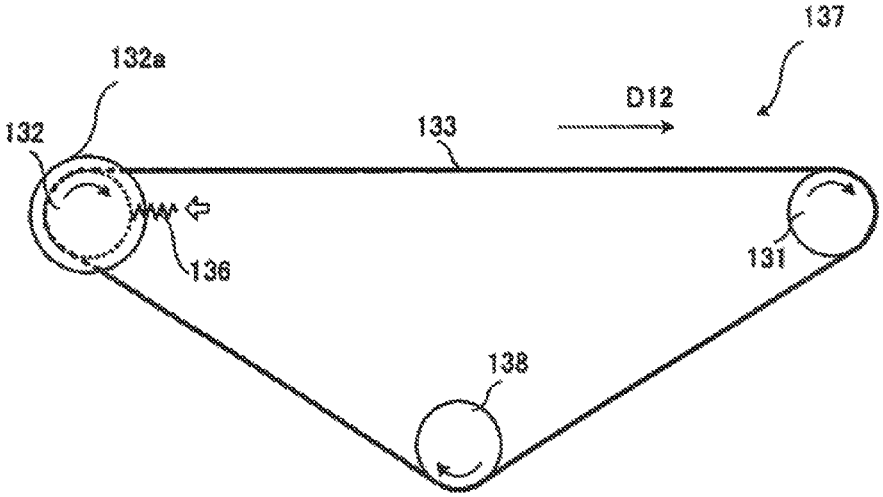
FIG. 9 is a longitudinal sectional view schematically showing a structure of a belt unit included in the image formation apparatus shown in FIG. 7.
Figure 12:
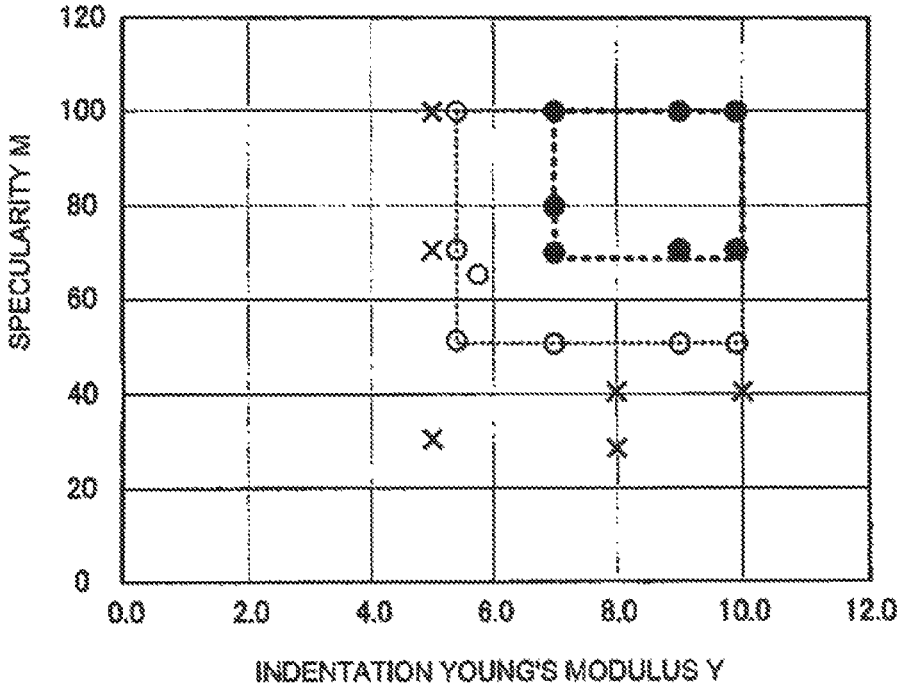
FIG. 12 is a graph showing the measured values in the examples shown in FIG. 10.

FIG. 7 is a longitudinal sectional view schematically showing a structure of an image formation apparatus according to a modified example of the first embodiment. FIG. 8 is a longitudinal sectional view schematically showing a structure of a transfer unit included in image formation apparatus 2 shown in FIG. 7. FIG. 9 is a longitudinal sectional view schematically showing a structure of a belt unit included in the image formation apparatus shown in FIG. 7. In FIGS. 7 and 8, the same or corresponding parts as those shown in FIGS. 1 to 3 are denoted by the same reference numerals. As shown in FIG. 7, image formation apparatus 2 includes, as main components, image formation unit 10, paper feeder 120, transfer unit 130, fixer 40, and discharger 50.

As shown in FIG. 7, image formation unit 10 has image formation units 11, 12, 13 and 14 arranged along a conveyance path (in a horizontal direction in FIG. 7) of recording paper 22 and is detachably mounted on the apparatus, as in the case of FIG. 1.

As shown in FIG. 7, paper feeder 120 includes paper cassette 21, paper feed roller 23 configured to take recording paper 22 out of paper cassette 21, and conveyance roller 24 configured to carry recording paper 22 to second transfer roller 139 as a transfer unit. Recording paper 22 stored in paper cassette 21 is taken out one by one by paper feed roller 23, carried in the D11 direction on a paper conveyance path, and sent to transfer roller 139 by conveyance rollers 24 and 25.

As shown in FIGS. 7 and 8, transfer unit 130 includes drive roll 131 and driven rolls 132 and 138 rotatably supported inside image formation apparatus 2. Endless belt 133 is provided around rolls .131, 132 and 138 and is configured to convey toner images on its outer peripheral surface by electrostatic adsorption. As shown in FIG. 7, endless belt 133 includes a first surface (inner peripheral surface) 55 facing the rolls 131, 132 and 138, and endless belt includes a second surface (outer peripheral surface) 56 opposite to the first surface. First transfer roller 134 as a transfer unit is configured to transfer the toner image carried on photosensitive drum 61 to endless belt 133. Cleaning blade 135 as a cleaning unit is configured to scrape off the residual toner by coming into contact with the outer peripheral surface of endless belt 133, and biasing member 136, such as an elastic member (e.g., a spring), is configured to bias driven roll 132 outward (in the D13 direction). As shown in FIG. 9, drive roll 131, driven rolls 132 and 138 and endless belt 133 are included in belt unit 137. Drive roll 131 is rotated to move endless belt 133 in the D12 direction. Endless belt 133 is tightened by drive roll 131 and driven rolls 132 and 138 in a state where tensile force (e.g., 6±10%[kg], i.e., 5.4 [kg] to 6.6 [kg]) is applied thereto by biasing member 136. Transfer roller 134 (or the first transfer unit) is disposed facing photosensitive drum 61 so as to sandwich endless belt 133 therebetween in order to transfer the toner image formed on photosensitive drum 61 to endless belt 133 as an intermediate transfer belt. First transfer roller 134 is disposed facing respective image formation units 11, 12, 13 and 14. Driven roll 132 may include flange 132*a* to prevent a meandering of endless belt 133 by coming into contact with the side of endless belt 133.

When the rotation of photosensitive drum 61 brings the toner image on the surface of each photosensitive drum 61 close to first transfer roller 134 and endless belt 133, the toner image on the surface of photosensitive drum 61 is transferred onto endless belt 33 by first transfer roller 134 and endless belt 133 to which a voltage is applied. This transfer of the toner image onto endless belt 33 is performed sequentially for toner images of respective colors of black (K), yellow (Y), magenta (M), and cyan (C). Accordingly, the toner images of the respective colors are superimposed on each other on endless belt 133, and thus a color image is formed.

Recording paper 22 stored in paper cassette 21 is taken out of paper cassette 21 by paper feed roller 23 and conveyed by conveyance rollers 24 and 25. When the rotation of photosensitive drum 61 brings the toner image on the surface of each photosensitive drum 61 close to second transfer roller 139 (or the second transfer unit), the toner image on endless belt 133 is transferred onto recording paper 22 by second transfer roller 139 to which a voltage is applied. Thus, a color toner image is formed on recording paper 22. Thereafter, recording paper 22 is conveyed to fixer 40. The toner image on recording paper 22 is fused by the pressure and heat from fixer 40, and is fixed onto recording paper 22. Subsequently, recording paper 22 is discharged onto discharge tray 52 by a discharge roller. Then, the image formation operation is completed. Meanwhile, the toner and foreign matter remaining on endless belt 133 after the separation of recording paper 22 are removed by cleaning blade 35.

Belt unit 137 is made of the same material as that of belt unit 37 described with reference to FIGS. 1 to 6. Therefore, belt unit 137 shown in FIGS. 7 and 9 prevents deterioration of endless belt 133 due to contact with a member such as cleaning blade 135.

Moreover, transfer unit 130 shown in FIGS. 7 and 8 prevents a deterioration of endless belt 133 due to contact with cleaning blade 135.

Furthermore, image formation apparatus 2 shown in FIG. 7 can prevent deterioration of endless belt 133, enhance the durability of the apparatus, and also improve the quality of images formed on recording paper 22.

<<2>> Second Embodiment

<<2-1>> Image Formation Apparatus, Transfer Unit and Belt Unit of the Second Embodiment An image formation apparatus of a second embodiment according to the invention has the same structure as that of image formation apparatus 1 or 2 (FIG. 1 or FIG. 7) of the first embodiment except for the conditions preferably satisfied by the endless belt. Therefore, FIGS. 1 and 7 are also referred to in the description of the second embodiment.

<<2-2>> Conditions Preferably Satisfied by the Belt Unit of the Second Embodiment FIG. 10 is Table 2A of results of experiments conducted to derive conditions satisfied by the second embodiment, showing the grounds for derivation of conditions (8) and (9) by hatching. Endless belt 33 (or 133) of the second embodiment is configured to satisfy conditions (1) to (4) described in the first embodiment and is further configured so that an indentation Young's modulus Y on an outer peripheral surface of endless belt 33 and a specularity M of the outer peripheral surface of endless belt 33 satisfy the following conditions (8) and (9).

$$5.5\ [\mathrm{GPa}] \leq Y \leq 10\ [\mathrm{GPa}] \quad (8)$$

$$50 \leq M \leq 100 \quad (9)$$

Conditions (8) and (9) are obtained based on the result of the test of the material of endless belt 133 under repeated stresses. FIG. 10 shows measured values of indentation Young's modulus Y and specularity M for different kinds of endless belts for test (Experimental Examples 21 to 40) as well as conditions for the indentation Young's modulus Y and specularity M that are preferably satisfied to allow endless belt 133 to have a predetermined cleaning performance. In Table 2A shown in FIG. 10, the hatching region shows the measured values that satisfy conditions (8) and (9).

A description is given below of the reason why conditions (8) and (9) need to be satisfied. As the surface of endless belt 33 becomes more uneven, a member in contact with the surface of endless belt 33 adheres more to the surface, and the cleaning blade 36 is more likely to leave unscraped matter on the surface. This is because, generally, as the total amount of printing increases, toner-derived or recording medium-derived (mainly paper-derived) matter is attached and deposited on endless belt 33. Such matter is likely to attract matter made of the same material, thus resulting in further adhesion. Note that the reason why the adhesion between matters having the same composition is strong is that these matters have a large intermolecular force and high compatibility.

Meanwhile, examples of the toner-derived or paper-derived matter mainly include silica and calcium carbonate. Because of their very high hardness, these materials can cause abrasion and scratches in endless belt 33 as the contact member. This phenomenon is likely to occur and progress when the indentation Young's modulus is 5.5 or less and the specularity is 50 or less. The reason why the indentation Young's modulus is employed as the condition in the second embodiment is that load application to the sample by a diamond indenter is similar to an actual situation (contact of the photosensitive drum with the endless belt, pressure by the toner, and scratches caused by the recording medium and the like) in the microscopic sense. Moreover, the "specularity" is an index obtained by quantifying the image clarity of the surface texture of the member. The value of specularity is obtained by calculating the sharpness of a reference pattern (reflected image) on the surface of an object to be measured as a relative value between a reference piece and an object based on a variation in brightness value (brightness) distribution. The specularity of the ideal surface to be the reference is 1000. The closer the specularity is to 1000, the better is the surface texture. The reason why the specularity is used as the condition specified in the second embodiment is as follows. Specifically, although there is a method of measuring surface roughness, gloss level and the like as a method for quantitatively measuring a microscopic shape of a surface of a material, such a method only measures some characteristics of the surface of the measured object. The image clarity is generally evaluated visually and is difficult to measure.

A description is given below of the reason for using conditions (8) and (9) in the second embodiment. First, when the specularity of the outer peripheral surface of endless belt 33 is 50 or less, it is difficult to secure a uniform line pressure of cleaning blade 35 to endless belt 33, thus resulting in a state where slipping of the toner is likely to occur. In other words, slipping is likely the higher the toner sphericity and the smaller the toner particle. Although the high image quality can be more easily obtained in general by use of toner in smaller particle size, the smaller particle size toner has a larger specific surface area, and the adhesion of the toner to endless belt 33 per unit weight is increased. As a result, the cleaning performance of endless belt 33 tends to be deteriorated. Furthermore, the smaller the particle size of the toner, the worse the fluidity. Thus, more additives such as silica and wax are required. However, the lower the specularity, the more likely the additives are to remain on the surface of endless belt 33, thus making slipping likely to occur. Moreover, in some cases, slipping of the toner causes a local shearing force to the cleaning blade. This may cause local chipping, leading to destruction of the cleaning blade.

Secondly, when the indentation Young's modulus Y of endless belt 33 is lower than 5.5 (GPa), scratches are likely to be caused on the surface of the endless belt. The smaller the indentation Young's modulus Y, the more the scratches are generated on the surface of the endless belt 33 by the foregoing silica and calcium carbonate having a high level of hardness in every printing operation. The small indentation Young's modulus Y leads to the development of scratches. As a result, adhesion between cleaning blade 35 and endless belt 33 is deteriorated, thus making poor cleaning likely to occur. This indicates that the high specularity M is not good enough for endless belt 33. Although the cleaning performance is good in the initial state, scratches are generated on the surface of endless belt 33 as printing is performed, thus gradually lowering the cleaning performance.

Third, when the indentation Young's modulus Y of endless belt 33 is lower than 5.5 [GPa] and the specularity M is lower than 50, the uneven surface of endless belt 33 makes wax or additives near the printing surface likely to be scraped off by microslip between endless belt 33 and the printing surface of the recording medium. This causes the wax or additives to adhere to the surface of endless belt 33. This wax or additives are accumulated in an edge portion of cleaning blade 35. As a result, the accumulated matter may slip through cleaning blade 35 and cause poor cleaning. Moreover, as the residues on endless belt 33 are increased, adhesion and affinity between cleaning blade 35 and the residues on endless belt 33 are increased, thereby causing a phenomenon that the friction is increased. This increase in friction causes an increase in shearing stress between the surface of endless belt 33 and cleaning blade 35. As a result, local chipping and turning up of cleaning blade 35 may occur.

The higher the print density, the more significant is the phenomena described above. As measures against such problems, it has been proposed to increase the line pressure of cleaning blade 35 to reduce the poor cleaning. However, the load on cleaning blade 35 is drastically increased, making it likely to damage the edge of cleaning blade 35 and to cause the turning-up. Moreover, increasing the line pressure may also accelerate the occurrence of scratches on the surface of endless belt 33, and is thus not preferable.

Meanwhile, when the specularity is higher than 100, the adhesion between cleaning blade 35 and endless belt 33 is increased and thus the friction is significantly increased. As a result, the torque to drive endless belt 33 is increased, and a power unit is accordingly increased in size. This increase in friction causes an increase in shearing stress between the surface of endless belt 33 and cleaning blade 35. As a result, local chipping and a turning up of cleaning blade 35 are likely to occur.

It is technically very difficult to manufacture endless belt 33 having an indentation Young's modulus Y higher than 10 [GPa]. An expensive facility and a great deal of time are required to manufacture such endless belt 33. This lowers the yield of endless belt 33 and increases the cost, making it substantially impossible to use such an endless belt for the image formation apparatus.

As can be seen from the hatching regions in FIG. 10 showing the measured values for Experimental Examples 21 to 40, satisfying both conditions (8) and (9) makes it possible to set all the evaluation results on the cleaning performance of endless belt 33 to "no poor cleaning" (Evaluation: black circle "●") and "only minor poor cleaning" (Evaluation: white circle "○"). In Table 2A shown in FIG. 10, Experimental Examples 24 to 31, 34 to 36 and 38 to 40 satisfy conditions (8) and (9). Therefore, Experimental Examples 24 to 31, 34 to 36 and 38 to 40 are examples corresponding to one embodiment of the invention, while the other Experimental Examples 21 to 23, 32, 33 and 37 are comparative examples of the invention.

FIG. 11 is Table 2B of results of experiments conducted to derive conditions satisfied by the second embodiment, showing the grounds for derivation of conditions (10) and (11) by hatching. It is preferable that endless belt 33 of the second embodiment is configured to satisfy conditions (1) to (4) described above. Endless belt 33 is further configured so that an indentation Young's modulus Y on the outer peripheral surface of endless belt 33 and a specularity M of the outer peripheral surface of endless belt 33 satisfy the following conditions (10) and (11).

$$7.0\ [\mathrm{GPa}] \leq Y \leq 10\ [\mathrm{GPa}] \quad (10)$$

$$70 \leq M \leq 100 \quad (11)$$

Conditions (10) and (11) are obtained based on the result of the test of the material of endless belt 33 under repeated stresses. FIG. 11 shows measured values of indentation Young's modulus Y and specularity M for different kinds of endless belts for test (Experimental Examples 21 to 40). FIG. 11 also shows conditions for the indentation Young's modulus Y and specularity M that are preferably satisfied in order to allow endless belt 33 to have a predetermined cleaning performance. In Table 2B shown in FIG. 11, the hatching region shows the measured values that satisfy conditions (10) and (11).

As can be seen from the hatching regions in FIG. 11 showing the measured values for Experimental Examples 21 to 40, satisfying both conditions (10) and (11) makes it possible to set all the evaluation results on the cleaning performance of endless belt 33 to "no poor cleaning" (Evaluation: black circle "●"). In Table 2B shown in FIG. 11, Experimental Examples 29 to 31, 35, 36, 39 and 40 satisfy conditions (10) and (11).

Note that endless belt 33 in belt unit 37 of the second embodiment preferably satisfies conditions (3), (4), (5), (8) and (9) rather than conditions (1) to (4), (8) and (9).

Moreover, endless belt 33 in belt unit 37 of the second embodiment preferably satisfies conditions (1) to (3), (7), (8) and (9) rather than conditions (1) to (4), (8) and (9).

Note that endless belt 33 in belt unit 37 of the second embodiment preferably satisfies conditions (3), (4), (5), (10) and (11) rather than conditions (1) to (4), (10) and (11).

Moreover, endless belt 33 in belt unit 37 of the second embodiment preferably satisfies conditions (1) to (3), (7), (10) and (11) rather than conditions (1) to (4), (10) and (11).

<<2-4>> Method for the Experiment Conducted to Derive Conditions (8) to (11)

An experiment to derive conditions (8) to (11) is performed as follows on the belt unit of Example 9 that is belt unit 37 shown in FIG. 3. A specularity measurement device used for measurement of specularity is "Mirror SPOT AHS-100S" manufactured by ARCHHARIMA Co. Ltd.

A measurement device used for measurement of the indentation Young's modulus Y is "Nano Indenter G200" manufactured by Toyo Technica Co., Ltd. The indentation Young's modulus is measured in accordance with ISO 14577 using Nano Indenter. "Nano Indenter" is a device configured to perform a loading-unloading test and measure a Young's modulus, hardness, and the like based on the load and indentation displacement. This device measures the Young's modulus, hardness, and the like by pushing in a sample with an indenter and detecting an elasto-plastic deformation. Since the indentation test can be performed with a minute load, indentation Young's moduli Y of the electrode surface or film structure of the sample can be measured. Note that a measurement method, requirements on the device, correction of the measurement and the like are stipulated by ISO 14577, and the measurement device conforms to the stipulation. The measurement of the indentation Young's modulus Y in FIG. 10 is performed under the following conditions using a Berkovich diamond indenter. An approach speed of the diamond indenter is set to 10 [nm/sec], the maximum load of the diamond indenter is set to 10 [mN], the time-to-maximum load by the diamond indenter is set to 10 [sec], the peak load retention time by the diamond indenter is set to 5 [sec], and the drift rate is set to 1 [nm/sec].

Figure 13:
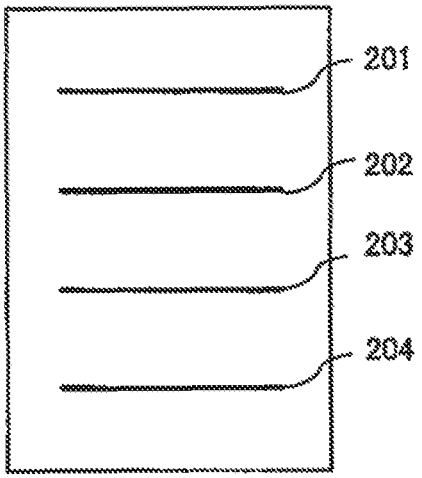
FIG. 13 is a view showing a test print pattern used for cleaning performance evaluation test by the image formation apparatus of the second embodiment.
Figure 14:
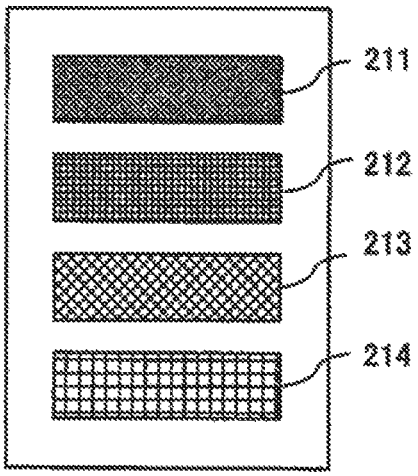
FIG. 14 is a view showing a test print pattern used for the cleaning performance evaluation test by the image formation apparatus of the second embodiment.
Figure 15:
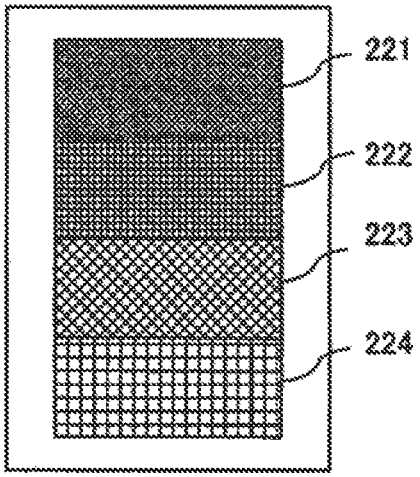
FIG. 15 is a view showing another test print pattern used for the cleaning performance evaluation test by the image formation apparatus of the second embodiment.

The cleaning performance evaluation test is performed using Printer "C5800n" manufactured by Oki Data Co., Ltd. The line speed of endless belt 33 is about 90 [mm/sec], and A4 size paper is used as the recording paper. The print pattern is printed at a density of 0.5[%] assuming printing of a general text (regions 201 to 204 in FIG. 13), 7[%] assuming printing of graphs and pictures in some part (regions 211 to 214 in FIG. 14), and 25[%] assuming that the entire paper has a background (regions 221 to 224 in FIG. 15). As printing conditions, printing is performed with "3P/J", i.e., repeating a cycle of 3-sheet printing and 7-sec rest, up to 60k image (printing of 60000 sheets) that is the life of endless belt 33. The determination is made on how much toner adheres to the rear surface of the recording paper (the surface on endless belt 33 side) (i.e., offset level): "no poor cleaning" (Evaluation: "● (black circle)"), "minor poor cleaning" (Evaluation: "○ (white circle)"), and "poor cleaning" (Evaluation: "x (cross mark)").

Note that while Experimental Examples 21 to 40 are those for the belt unit of Example 9, the same effects can be obtained for the belt units of the other examples than Example 9.

<<2-5>> Effects of Second Embodiment

Belt unit 37 of the second embodiment prevents deterioration of endless belt 33 due to contact with a member such as cleaning blade 35, and thus improves the reliability of the cleaning performance of endless belt 33.

Moreover, transfer unit 30 of the second embodiment prevents deterioration of endless belt 33 due to contact with cleaning blade 35, and thus improves the reliability of the cleaning performance of endless belt 33.

Furthermore, the image formation apparatus of the second embodiment can prevent deterioration of endless belt 33, enhance the durability of the apparatus, and also improve the quality of images formed on recording paper 22.

<<3>> Utilization of the Invention

Belt units 37 and 137, transfer units 30 and 130, and image formation apparatuses 1 and 2, to which the invention is applied, can be used for the image formation apparatus employing endless belt 33 or 133 of an electrophotographic printer, and can also be used for a multifunction printer (MFP), a fax machine and the like other than the printer.

A belt unit made of the same material as that of belt units 37 and 137 to which the invention is applied can be used as other endless belts, such as a photosensitive belt as an image carrier, a fixing belt as a pressure roller included in a fixer, and a conveyance belt for conveying recording paper.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A belt unit comprising:

rolls being rotatably supported; and a belt to be conveyed by the rolls, wherein in a dynamic viscoelasticity test with conditions of tensile load set in a frequency range of 0.01 to 100 Hz, the belt unit satisfies $$1 \le G_{10}/G_{70} \le 3.1 \text{ and}$$

$$L_{70} \ge 10 \text{[MPa]}$$

where a storage elastic modulus of the belt at a temperature of 10° C. is indicated by $G_{10}$, a storage elastic modulus of the belt at a temperature of 70° C. is indicated by $G_{70}$, and a loss elastic modulus of the belt at a temperature of 70° C. is indicated by $L_{70}$.

2. The belt unit according to claim 1, wherein the belt unit satisfies $$G_{10} \ge 100 \text{ [MPa] and}$$

$$G_{70} \ge 100 \text{ [MPa].}$$

3. The belt unit according to claim 2, wherein the belt unit satisfies $$G_{10} \ge 1000 \text{ [MPa] and}$$

$$G_{70} \ge 1000 \text{ [MPa].}$$

4. The belt unit according to claim 1, wherein the belt unit satisfies $$L_{70} \ge 100 \text{ [MPa].}$$

5. The belt unit according to claim 1, wherein the belt has a first surface facing the rolls and a second surface opposite to the first surface, and the belt satisfies $$5.5\text{[GPa]} \le Y \le 10\text{[GPa] and}$$

$$50 \le M \le 100,$$

where an indentation Young's modulus on the second surface of the belt is indicated by Y and a specularity of the second surface of the belt is indicated by M.

6. The belt unit according to claim 5, wherein the belt satisfies $$7.0\text{[GPa]} \le Y \le 10\text{[GPa] and}$$

$$70 \le M \le 100.$$

7. The belt unit according to claim 1, wherein at least one of the rolls is a drive roll rotated by receiving a rotational drive force.

8. The belt unit according to claim 1, wherein the belt has a first surface facing the rolls and a second surface opposite to the first surface, the belt unit further comprising:

a cleaning member in contact with the second surface of the belt.

9. The belt unit according to claim 8, wherein the cleaning member includes a blade unit in contact with the second surface of the belt.

10. A transfer unit comprising:

the belt unit according to claim 1 wherein the belt has a first surface facing the rolls and a second surface opposite to the first surface; and a first transfer unit disposed facing the first surface and configured to transfer a developer image from an image carrier facing the second surface onto a recording medium disposed on the second surface of the belt or onto the second surface of the belt.

11. The transfer unit according to claim 10, wherein the belt is an endless belt that is disposed with an inner peripheral surface of the endless belt being in contact with the rolls, and is to be conveyed by the rolls, the first surface is the inner peripheral surface of the belt, and the second surface is an outer peripheral surface of the belt.

12. A transfer unit comprising:

the belt unit according to claim 1 wherein the belt has a first surface facing the rolls and a second surface opposite to the first surface;

a first transfer unit disposed facing the first surface and configured to transfer a developer image from an image carrier facing the second surface onto the second surface of the belt; and a second transfer unit disposed facing the second surface and configured to transfer a developer image from the second surface onto a recording medium conveyed between the second surface and the second transfer unit.

13. The transfer unit according to claim 12, wherein the belt is an endless belt, disposed with an inner peripheral surface of the endless belt being in contact with the rolls, and configured to be conveyed by the rolls, the first surface is the inner peripheral surface of the belt, and the second surface is an outer peripheral surface of the belt.

14. An image formation apparatus comprising:

the transfer unit according to claim 10; and an image formation unit having the image carrier.

15. The image formation apparatus according to claim 14, further comprising:

a medium storage unit that stores the recording medium.

16. An image formation apparatus comprising:

the transfer unit according to claim 12; and an image formation unit having the image carrier.

17. The image formation apparatus according to claim 16, further comprising:

a medium storage unit that stores the recording medium.

18. The belt unit according to claim 1, wherein $$1800\ [\mathrm{MPa}] \leq G_{10} \leq 9500\ [\mathrm{MPa}]$$

$$1200\ [\mathrm{MPa}] \leq G_{70} \leq 5500\ [\mathrm{MPa}] \text{ and}$$

$$100\ [\mathrm{MPa}] \leq L_{70} \leq 800\ [\mathrm{MPa}].$$

19. The belt unit according to claim 18, wherein $$1 \leq G_{10}/G_{70} \leq 3.1.$$

20. An image formation apparatus, comprising:

the belt unit according to claim 19, and an image carrier provided facing a belt surface of the belt unit.

* * * * *